United States Patent [19]

Cobb et al.

[11] Patent Number: 4,476,387

[45] **Date of Patent: * Oct. 9, 1984**

[54] CORONA CHARGING APPARATUS

[75] Inventors: Harold W. Cobb, Acton; Richard A. Fotland, Holliston, both of Mass.

[73] Assignee: Delphax Systems, Mississauga, Canada

[ * ] Notice: The portion of the term of this patent subsequent to Apr. 12, 2000 has been disclaimed.

[21] Appl. No.: 483,805

[22] Filed: Apr. 11, 1983

Related U.S. Application Data

[63] Continuation of Ser. No. 237,559, Feb. 24, 1981, Pat. No. 4,379,969.

[51] Int. Cl.[3] ..... H01T 19/04

[52] U.S. Cl. ..... 250/324; 361/230

[58] Field of Search ..... 250/324, 325, 326; 361/229, 230, 235

[56] References Cited

U.S. PATENT DOCUMENTS

| | | | |
|---|---|---|---|
| 3,370,212 | 2/1968 | Frank | 250/326 |
| 3,742,301 | 6/1973 | Burris | 361/230 |
| 4,057,723 | 11/1977 | Sarid et al. | 250/326 |
| 4,068,284 | 1/1978 | Wheeler et al. | 361/230 |
| 4,086,650 | 4/1978 | Davis et al. | 361/230 |

*Primary Examiner*—Bruce C. Anderson

*Attorney, Agent, or Firm*—George E. Kersey; Arthur B. Moore; Barry D. Josephs

[57] ABSTRACT

A corona charging device including a dielectric-coated elongate conductor contacting or closely spaced from a grid electrode, mounted against an insulating support. A high voltage varying potential between the elongate conductor and grid electrode induces a glow discharge in the vicinity of the dielectric-coated electrode. The grid electrode may act as a ground plane to provide a corona discharge device with respect to a proximate member. Alternatively, the grid electrode may be maintained at a desired potential to provide a charging device with an automatically limited voltage.

22 Claims, 8 Drawing Figures

FIG. 1
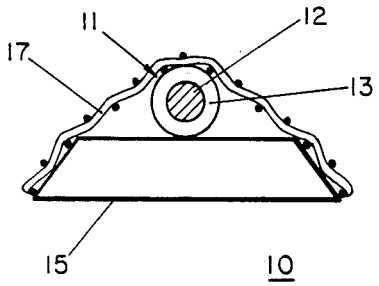
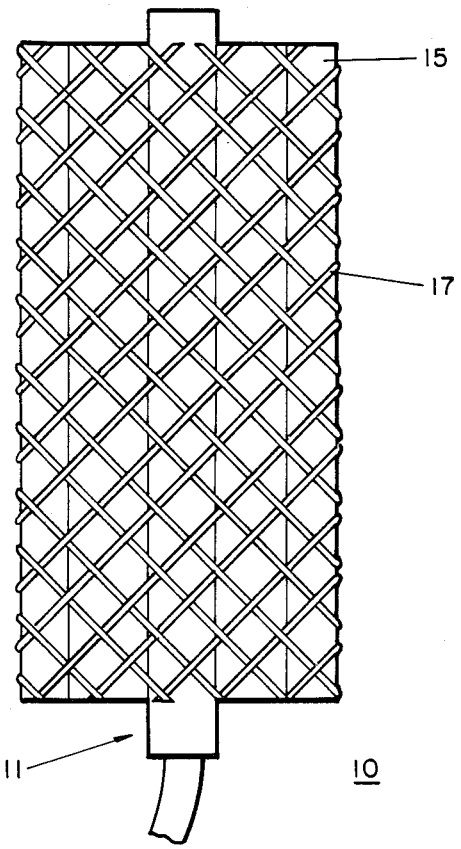
FIG. 2
FIG. 3
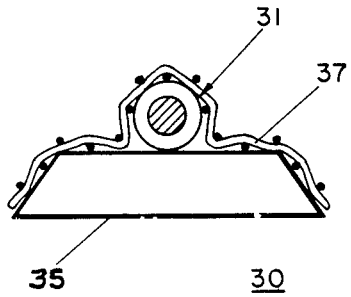

CORONA CHARGING APPARATUS

This is a continuation of Ser. No. 237,559, filed Feb. 24, 1981, U.S. Pat. No. 4,379,969.

BACKGROUND OF THE INVENTION

The present invention relates to corona charging devices, particularly as used for discharging electrostatic images.

Corona charging devices in the form of thin conducting wires or sharp points are well known in the prior art. Illustrative U.S. Pat. Nos. are Vyverberg 2,836,725; L. E. Walkup 2,879,395; P. Lee 3,358,289; Lee F. Frank 3,611,414; A. E. Jvirblis 3,623,123; P. J. McGill 3,715,762; H. Bresnik 3,765,027; and R. A. Fotland 3,961,564. Such devices are used almost exclusively in electrostatic copiers to charge photoconductors prior to exposure as well as for discharging. Standard corona discharges provide limited ion currents. Such devices as a rule achieve a maximum discharge current density on the order of 10 microamperes per square centimeter. Additionally, corona wires are small and fragile, and easily broken. Because of their high operating potentials they collect dirt and dust and must be frequently cleaned or replaced, in order to avoid fall-off of the emission current.

Corona discharges which enjoy certain advantages over standard corona apparatus are disclosed in Sarid et al. U.S. Pat. No. 4,057,723; Wheeler et al. 4,068,284; and Sarid 4,110,614. These patents disclose various corona charging devices characterized by a conductive wire coated with a thick dielectric material, in contact with or closely spaced from a further conductive member. Various geometries are disclosed in these patents, all fitting within the above general description. These devices utilize an alternating potential in order to generate a source of ions, and a DC extraction potential. The patents disclose a preferred biasing range of 2000–6000 volts, relatively high values which are required in order to obtain significant extraction currents and therefore higher charging rates. These current outputs are exponential in character, in contrast to the fairly linear outputs of the present invention. In addition, these devices are undesirably sensitive to variations in the gap width between the corona and the imaging member.

U.S. Pat. No. 4,153,093 discloses ion generating apparatus which may be used for charge neutralization as well as deposition of net charge. This apparatus is superior to standard corona apparatus, but is difficult to fabricate, and does not provide the high charging rates of the present invention.

Accordingly it is a principal object of the invention to provide charging and neutralizing devices employing corona discharges which have superior performance as compared with prior art corona devices.

Another object of the invention is to provide a corona charging device which achieves high current densities. A related object is the achievement of high charging rates. Another related object is the avoidance of high biasing potentials in providing such charging rates.

A further object of the invention is to provide a charging device having a rugged and compact structure. A related object is to provide a device having a longer operational life than is customary in corona ion generators. A further related object is the provision of corona apparatus which does not require frequent servicing.

Another object is to provide a corona charging device capable of charging or discharging a remote dielectric or photoreceptor surface to potentials within a few volts of a preselected potential.

Still another object of the invention is the avoidance of emission current fall-off as the ion generator becomes slightly dirty. A related object is the achievement of uniform emission currents. Yet another object of the invention is the provision of a corona charging device with a reliable output potential.

SUMMARY OF THE INVENTION

In achieving the above and related objects, the invention provides a corona charging device comprising an elongate conductor with a dielectric sheath, and an overlying conductive grid. The dielectric sheathed conductor and conductive grid are both mounted against an insulating substrate. This apparatus may be used for corona charging and discharging by means of a varying potential between the elongate conductor and the conductive grid. The conductive grid is maintained at ground potential for charge neutralization, and at a limiting bias potential for corona charging.

In accordance with one aspect of the invention, the grid electrode comprises a one or two directional array of fine conductive members. In the preferred embodiment, the grid electrode comprises a fine wire mesh screen. In an alternative embodiment, the grid comprises a parallel array of fine, closely spaced wires, transverse to the axis of the elongate conductor.

In accordance with another aspect of the invention, the elongate conductor may have a variety of cross sections. In the preferred embodiment, the elongate conductor comprises a cylindrical wire. In an alternative embodiment, this electrode comprises an etched foil. In accordance with a related aspect of the invention a variety of insulating materials, preferably inorganic, may be utilized in the dielectric sheath for the elongate conductor.

In accordance with a further aspect of the invention, the conductive grid and the dielectric sheathed conductor form substantially parallel electrodes. In accordance with a related aspect, the grid may have a variety of transverse cross sections wherein the grid contacts or is closely spaced from the dielectric sheath at or near its outer surface.

In accordance with an alternative embodiment of the invention, the corona charging apparatus may include a thin dielectric separating the conductive grid from the elongate conductor, but not completely covering the latter member.

In accordance with a further alternative embodiment of the invention, the insulating substrate may include a slot to house the dielectric sheathed conductor. In this embodiment, the dielectric sheathed conductor is embedded in the slot along its length, and the conductive grid is mounted over this member at a point at which it protrudes from the slot.

In accordance with yet another aspect of the invention, the varying potential is advantageously a continuous wave alternating potential in the range 600 to 1500 volts peak, with a frequency in the range 60 Hz to 10 MHz. Alternatively, the varying potential may comprise a pulsed voltage. In the embodiment for corona charging, the extraction potential preferably is on the order of tens or hundreds of volts.

In a preferred embodiment of the invention, the device is employed for the erasure of electrostatic images on a proximate member. In an alternative embodiment, the device is employed for charging such a dielectric member to a prescribed voltage. In the latter case the device of the invention provides automatic control of the charging level. In either embodiment, the corona device is advantageously disposed at a distance in the range 5–20 mils from the member to be charged or discharged.

BRIEF DESCRIPTION OF THE DRAWINGS

The above and additional aspects of the invention are illustrated in the detailed description which follows, taken in conjunction with the drawings in which:

FIG. 1 is a sectional view of a corona charging device in accordance with a preferred embodiment of the invention;

FIG. 2 is a plan view of the charging device of FIG. 1;

FIG. 3 is a sectional view of a charging device with an alternative grid electrode profile;

DETAILED DESCRIPTION

Figure 4:
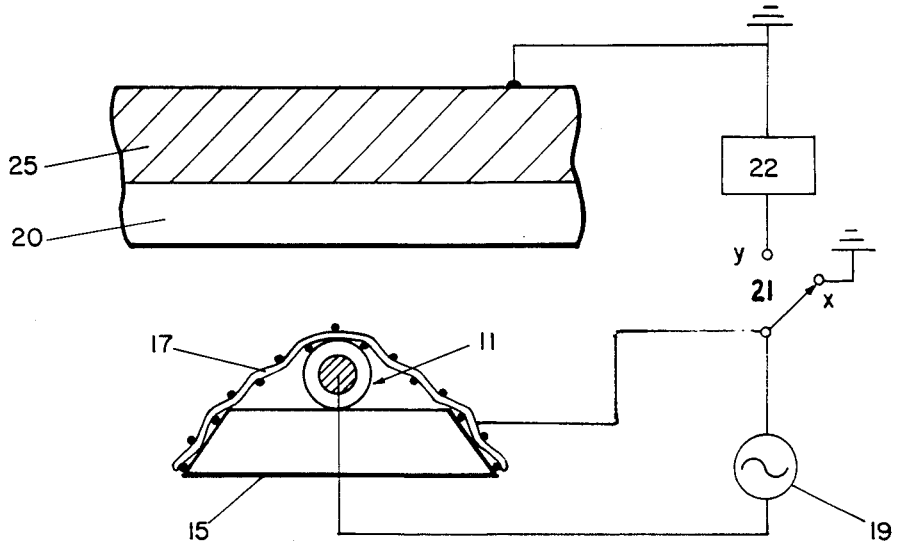
FIG. 4 is a sectional view of the charging device of FIG. 1, deployed for charging or discharging an adjacent member.

Reference should now be had to FIGS. 1–10 for a detailed description of the corona charging apparatus of the invention. FIG. 1 is a sectional view of an illustrative corona device 10. The corona device includes a corona electrode 11 mounted on an insulating substrate or support 15, with a conductive grid electrode 17 overlying electrode 11. A characteristic feature of corona device 10, as shown in the plan view of FIG. 2, is that corona electrode 11, grid electrode 17, and substrate 15 form a linear structure.

Figure 7:
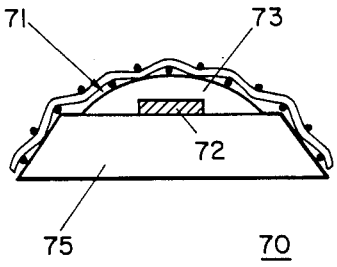
FIG. 7 is a sectional view of a charging head with an alternative corona electrode construction.
Figure 8:
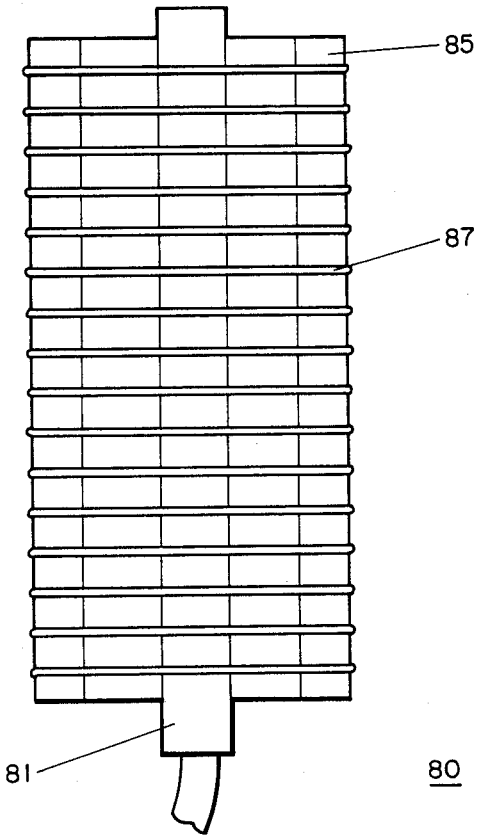
FIG. 8 is a plan view of a charging device with an alternative grid electrode.

Corona electrode 11 consists of a conductor 12 in the form of a wire (which may consist of any suitable conductive material) encased in a thick dielectric 13. Although a dielectric-coated cylindrical wire is illustrated in the preferred embodiments, the electrode 11 is more generally described as an elongate conductor having a cross-section of indeterminate shape and including a dielectric sheath. FIG. 7 illustrates an alternative corona electrode construction. Corona electrode 71 comprises a thin etched conductor 72 with dielectric encapsulation 73. The elongate conductor may rest directly in contact with the insulating support, as long as it is separated from the mesh electrode by the dielectric sheath.

Electrode 11 is placed against insulating substrate 15. Advantageously, the corona electrode 11 is constrained by grid electrode 17, but is not bonded to the insulating substrate. This arrangement permits relative movement of these structures due to thermal expansion and contraction. The substrate 15 consists of insulating material of sufficient rigidity to support the coated-wire electrode 11 and grid electrode 17.

Grid electrode 17 comprises an array of elongate conductors of minute thickness as compared with the diameter of dielectric-coated electrode 11. In the preferred embodiment of the invention, this electrode comprises a fine wire mesh screen, advantageously a screen with a mesh in the range 30–150 apertures/inch, and a wire thickness in the range 0.3–1.2 mils. Preferably, the wire mesh screen is characterized by a high percentage of open area. The screen may consist of any well known metal or metal alloy, such as steels, stainless steels, nickel-chromium alloys, copper alloys, and aluminum alloys. The use of a fine mesh provides a desirably high density of ion generation sites, and avoids overheating at crossover points. In an alternative embodiment, the grid electrode is fabricated by photoetching a screen pattern on a metal foil. In a further alternative embodiment illustrated at 80 in FIG. 8, grid electrode 87 consists of a parallel array of fine, closely spaced wires running perpendicular to corona electrode 81.

Returning to FIG. 1, the grid electrode 17 is wrapped over electrode 11, and is anchored to insulating substrate 15 at each side of electrode 11. The grid electrode 17 may describe any of a wide variety of profiles as seen from one end. In the preferred embodiment illustrated in FIG. 1, the grid electrode 17 is wrapped tightly over the apex of electrode 11, and is bonded to supporting substrate 15 so as to form a roughly V-shaped profile. An alternative arrangement is shown in at 30 FIG. 3, wherein a grid electrode 37 forms an arch over the corona electrode 31. The former profile is preferred, in that the closeness of the grid electrode 17 to the outer surface of dielectric 13 provides a desirably low cutoff voltage. For this reason, grid electrode 17 is advantageously bonded or attached to supporting substrate 15 in such a manner as to tension the mesh to provide firm contact with the electrode 11.

With reference to the sectional view of FIG. 4, the device 10 is employed for the generation of ions by application of a time-varying potential 19 between the elongate conductor 12 and grid electrode 17. This causes a pool of positive and negative ions to be formed in an air space in the vicinity of that portion of grid electrode 17 which is in contact with or close proximity to dielectric 13. This phenomenon is herein termed "glow discharge." With a periodically varying potential 19, air gap breakdown occurs during each half cycle if the excitation potential exceeds approximately 1400 volts peak-to-peak, if the dielectric sheath thickness is in the range of two to three mils. The dielectric 13 will receive a net charge, thereby extinguishing the discharge, and preventing the direct flow of an in-phase current between grid electrode 17 and elongate conductor 12.

With the switch in position x, the corona device 10 acts as a charge neutralizing device with respect to an electrostatic image carried on a proximate member. As seen in FIG. 4, the device 10 is disposed adjacent a dielectric layer 20 having a conductive substrate 25, and the grid electrode 17 is grounded to substrate 25. The electrical behavior of this device may be measured as a plot of output current, i, as a function of the voltage V between the surface of layer 20 and electrode 17. Typically, the devices of the invention are characterized by roughly linear i-V curves. It is preferable to have a low offset voltage $V_0$, i.e. voltage at which $i=0$.

If dielectric layer 20 carries any net positive or negative charge, this charge on its surface, will establish an electrical field to grid electrode 17, causing the extraction of ions of the opposite polarity from the ion pool. If the corona device 10 is thus disposed for a sufficient period of time, the surface of layer 20 will be completely neutralized, so that the surface bears little or no residual charge under these circumstances. Another desirable feature is that of the typically high charging-/discharge rates of this device.

Advantageously, the corona device 10 is disposed at a distance in the range 5–20 mils from layer 20, most preferably around 15 mils, as measured from the outer surface of grid electrode 17. A further advantageous feature of the invention is that the offset voltage of this device is relatively insensitive to changes in gap width within this range.

With further reference to FIG. 4, the device 10 may be utilized to deposit a net positive or negative charge on layer 20 when switch 21 is at position y. This places a DC bias potential 22 on grid electrode 17. With a positive bias to electrode 17, for example, a positive charge of equal magnitude will be deposited on surface 20. When operated in this mode, the corona device 10 provides automatic limiting of the charging potential.

In the preferred embodiment, time varying potential 19 comprises a high frequency, high voltage sinusoid. Preferably, excitation potential 19 has a magnitude in the range 1700–2500 volts peak-to-peak, most advantageously around 2000 volts peak-to-peak. Excitation potential 19 may comprise a continuous wave alternating potential, preferably of a frequency in the range 10 KHz to 1 MHz. Driving voltages at higher frequencies have been observed to cause overheating of the corona device, while lower frequency waveforms may provide inadequate output currents. A continuous wave frequency of 100 KHz provides desirably high emission currents without a serious risk of overheating device 10. Alternatively, excitation potential 19 may comprise a pulsed voltage which may be specified by the parameters of peak-to-peak voltage, repetition period, pulse width, and base frequency. The device 10 has been operated at frequencies as high as 1 MHz applied in short bursts having a duty cycle near 10 percent.

The dielectric 13 should have sufficient dielectric strength to withstand high excitation potentials without dielectric breakdown. It is desirable to minimize the onset voltage, i.e. the excitation voltage at which the dielectric begins to charge. This voltage increases with thicker dielectric layers 13, and decreases with lower dielectric constants of that layer. Organic dielectrics are generally unsuitable for this application, as most such materials tend to degrade with time due to oxidizing products formed in atmospheric electrical discharges. In the preferred embodiment, the dielectric 13 comprises a fused glass layer which is fabricated in order to minimize voids, having a thickness in the range 1–3 mils. Other suitable materials include, for example, sintered ceramics and mica.

Figure 5:
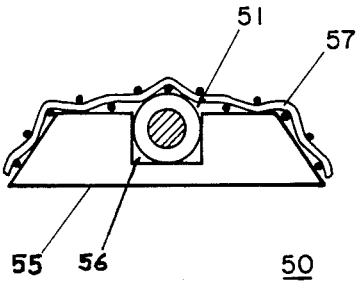
FIG. 5 is a sectional view of an alternative charging device design.

An alternative construction of corona device is shown at 50 in FIG. 5. The insulating substrate 55 includes a slot 56 in which corona electrode 51 is fitted. The grid electrode 57 is wrapped over substrate 55 and electrode 51 as shown. This arrangement affords ease of positioning and supporting corona electrode 51.

Figure 6:
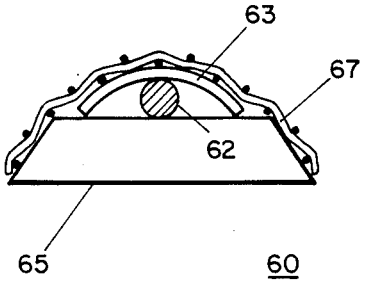
FIG. 6 is a sectional view of a further charging device design.

As shown in FIG. 6, the conductive core of the corona electrode need not be encased in a dielectric sheath for effective operation. In an alternative device 60, the dielectric sheath is replaced by a thin, flexible dielectric strip 63. The elongate conductor 62 rests directly against insulating substrate 65, and is separated from grid electrode 67 by dielectric strip 63. This strip may comprise, for example, mica or a thin strip of glass.

The invention is further illustrated in the following nonlimiting examples:

EXAMPLE 1

A corona charging device of the type shown in FIG. 1 was constructed as follows. The insulating substrate was fabricated of glass epoxy G-10 laminate. The corona electrode consisted of a 7 mil diameter stainless steel wire having a 2 mil thick glass coating. After laying the coated wire on the substrate, a fine woven electrode screen was stretched over the wire and bonded with a thermoset adhesive to the sides of the substrate. The screen was composed of a plain woven 1 mil stainless steel wire, having a mesh count of 100 and an open area of approximately 90 percent. The coated wire electrode was not bonded to the substrate, and was constrained only by the overlying screen.

A 100 KHz, 2000 volt continuous wave alternating potential was placed between the coated wire electrode and the grid electrode. The outer surface of the grid electrode was located 15 mils from the surface of an imaging drum having a thin photoconductive surface layer, with a capacitance of 100 picofarads per $cm^2$. The photoconductive surface was charged to 500 volts with a charging rate of $10^3$ $cm^2$/sec., by imposing a 500 volt direct current potential between the grid electrode and the drum's conductive core. This represented an average corona output current of 10 microamperes per cm. length of corona.

EXAMPLE 2

The apparatus of Example 1 was employed as a corona discharge device by grounding the mesh electrode to the photoreceptor drum's conductive core. In this mode, the device neutralized electrostatic images at rates comparable to the charging rates of Example 1, leaving virtually no residual electrostatic image.

EXAMPLE 3

The apparatus of Example 1 was modified as follows to provide a corona charging device of the type shown in FIG. 7. The corona electrode was fabricated by laminating a 1 mil stainless steel foil to the substrate using a pressure sensitive adhesive, and photoetching an electrode with a line width of 8 mils. The electrode was encapsulated with a 1.5 mil thick layer of glass by silk-screening a glass frit over the etched electrode, and sintering the glass at a high temperature to form a continuous glass coating.

This apparatus exhibited equivalent performance to the structure of Example 1, in both the charging and neutralizing modes.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Apparatus for generating free ions, comprising:

an elongate conductor;

an insulating support for the elongate conductor;

a dielectric member positioned with the elongate conductor between the insulating support and the dielectric member, said dielectric member having an outer surface remote from the elongate conductor;

a conductive grid contacting said outer surface;

varying potential means applied between the elongate conductor and the conductive grid in order to create a glow discharge, thereby to generate said free ions.

2. Apparatus as defined in claim 1 wherein the conductive grid comprises a conductive mesh electrode.

3. Apparatus as defined in claim 2 wherein the conductive mesh electrode comprises a wire mesh screen.

4. Apparatus as defined in claim 3 wherein the wire mesh screen has a mesh in the range 30–150 apertures per inch.

5. Apparatus as defined in claim 3 wherein the wire mesh electrode has a high open area ratio.

6. Apparatus as defined in claim 3 wherein the wire mesh screen comprises a lattice of wires having a thickness in the range 0.3–1.2 mils.

7. Apparatus as defined in claim 2 wherein the conductive mesh electrode comprises a metal foil etched in a mesh pattern.

8. Apparatus as defined in claim 1 wherein the conductive grid comprises an array of essentially parallel conductors.

9. Apparatus as defined in claim 1 wherein the conductive grid contacts the dielectric member along a line coextensive with the elongate conductor.

10. Apparatus as defined in claim 1 wherein the elongate conductor is a wire and dielectric member is a dielectric coating on the wire.

11. Apparatus as defined in claim 10 wherein the dielectric coating has a thickness in the range 1–3 mils.

12. Apparatus as defined in claim 1 wherein the dielectric member is of an inorganic dielectric material.

13. Apparatus as defined in claim 12 wherein the dielectric member is of a material selected from the class consisting of glass, mica, and sintered ceramic materials.

14. Apparatus as defined in claim 1 wherein the conductive grid is anchored to the insulating support at both sides of the elongate conductor and dielectric member.

15. Apparatus as defined in claim 1 wherein the conductive grid has an approximately V-shaped transverse cross-section.

16. Apparatus as defined in claim 1 wherein the conductive grid has an arcuate transverse cross-section.

17. Apparatus as defined in claim 1 and further comprising ion extraction means comprising:

a counterelectrode, and means creating a direct current potential between the conductive grid and the counterelectrode.

18. Apparatus as defined in claim 17 wherein the direct current potential has a magnitude between 10 and 1000 volts.

19. Apparatus as defined in claim 1 wherein the varying potential comprises a radio frequency alternating potential having an amplitude of at least one kilovolt.

20. Apparatus as defined in claim 1 wherein the varying potential comprises a pulsed voltage.

21. Apparatus as defined in claim 1 wherein the elongate conductor and dielectric sheath are housed in a slot in said insulating support, with said conductive grid contacting the dielectric sheath above the slot.

22. Apparatus as defined in claim 1 wherein the dielectric member does not completely cover the elongate conductor.

* * * * *